US006422147B1

(12) United States Patent
Shann

(10) Patent No.: US 6,422,147 B1
(45) Date of Patent: Jul. 23, 2002

(54) SEQUENTIAL DETONATION OF EXPLOSIVE CHARGES

(75) Inventor: Peter Shann, Fulford (GB)

(73) Assignee: Hatorex AG a Swiss limited liability company (CH)

( * ) Notice: Subject to any disclaimer, the term of this patent is extended or adjusted under 35 U.S.C. 154(b) by 0 days.

(21) Appl. No.: 09/508,153

(22) PCT Filed: Jul. 7, 1999

(86) PCT No.: PCT/GB99/02033

§ 371 (c)(1),
(2), (4) Date: Jun. 9, 2000

(87) PCT Pub. No.: WO00/02005

PCT Pub. Date: Jan. 13, 2000

(30) Foreign Application Priority Data

Jul. 7, 1998 (GB) ..... 9814592
Aug. 12, 1998 (GB) ..... 9817445

(51) Int. Cl.[7] ..... F42B 3/00
(52) U.S. Cl. ..... 102/312; 102/313; 102/320
(58) Field of Search ..... 102/311, 312, 102/313, 320

(56) References Cited

U.S. PATENT DOCUMENTS 4,976,199 A * 12/1990 Beukes et al. ..... 102/311 X
5,014,622 A * 5/1991 Jullian ..... 102/313 X
5,117,756 A * 6/1992 Goffin, III ..... 102/217
5,388,521 A * 2/1995 Coursen ..... 102/313 X
6,014,933 A * 1/2000 Umphries ..... 102/313 X
6,220,167 B1 * 4/2001 Yamamoto et al. ..... 102/313 X

FOREIGN PATENT DOCUMENTS

| | | | |
|---|---|---|---|
| EP | 601831 | | 6/1994 |
| EP | 601831 A1 | * | 6/1994 |
| FR | 2688583 | * | 9/1993 |
| WO | WO 93/18366 | | 3/1993 |
| WO | 93/18366 | * | 9/1993 |

* cited by examiner

*Primary Examiner*—Peter A. Nelson
(74) *Attorney, Agent, or Firm*—Madson & Metcalf

(57) ABSTRACT

A control system for controlling the initiation of detonation of a series of explosive charges (13) spaced apart from each other in boreholes (12) formed in a rock medium (10) to be blasted, said system being operative to apply controlled time difference in the time interval between successive detonations of at least one phase of the series of charges, and which includes at least three successive detonations, so as to reduce the probability of consecutive stimulation and amplification of ground vibration by reason of the detonation of the charges in the rock medium.

21 Claims, 2 Drawing Sheets

SEQUENTIAL DETONATION OF EXPLOSIVE CHARGES

Figure 1:
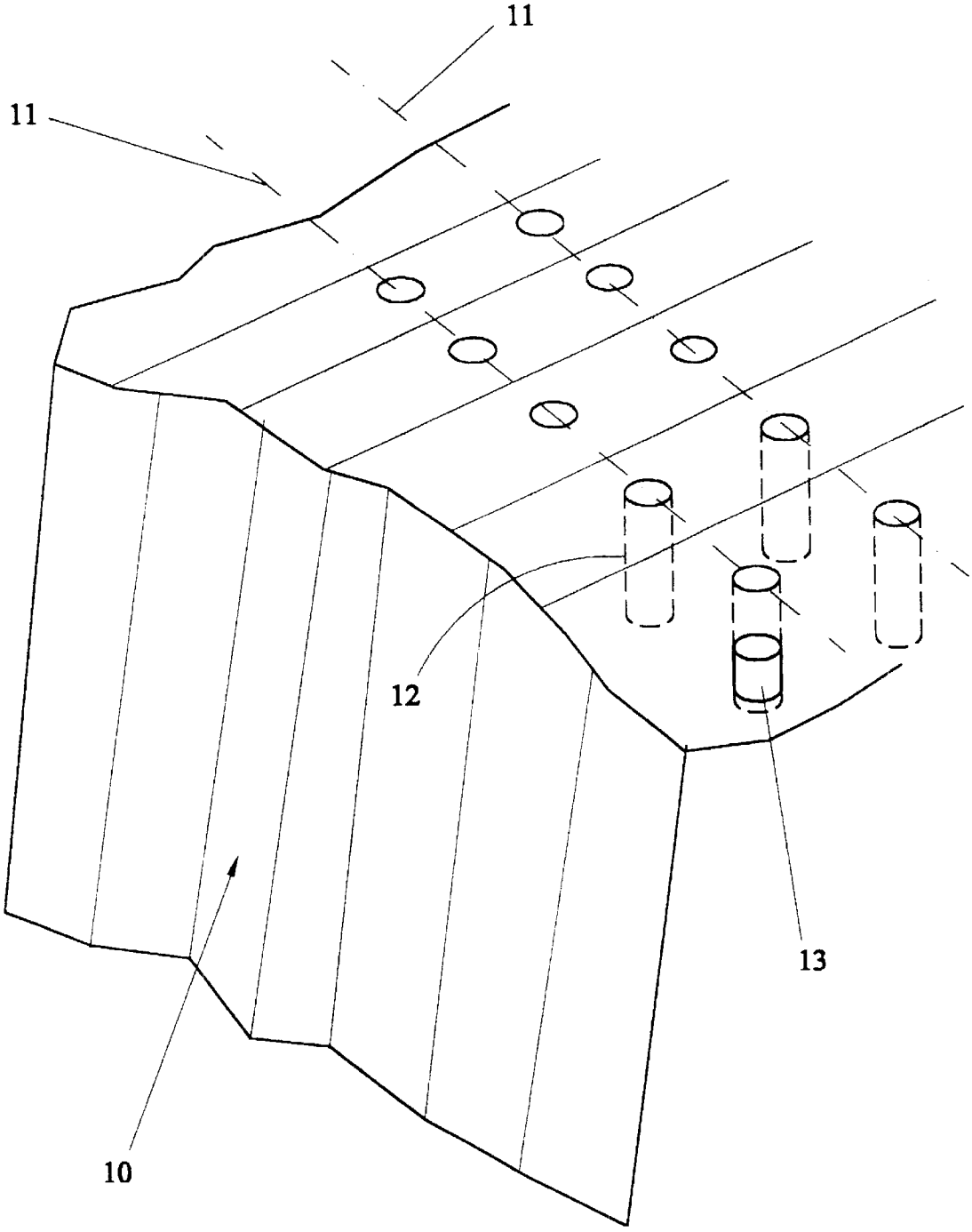

This invention is concerned with a method and apparatus for initiating sequential detonation of a series of explosive charges.

It is well known that improved blasting of a rock face can be achieved by arranging explosive charges in rows of spaced boreholes, and by initiating sequential detonation of the charges in each row, and also sequential detonation from one row to another. The purpose of this is to create a "free face" after each explosion before a successive explosion takes place.

In recent years, so-called "electronic detonators" have been used to an ever-increasing extent, with a view to achieving greater accuracy of control in the time interval between successive detonations. An electrical control circuit is provided to control the initiation of a blasting sequence, and which is intended to trigger detonation of each successive explosive charge at a predetermined time interval after the preceding detonation.

A considerable amount of research work has been carried out into the subject of control of the time interval between successive explosions. First of all, theoretical studies are carried out to determine the most favourable time interval, dependent upon (a) the nature of the rock medium and (b) the spacing-apart of the explosive charges. Then, electronic control apparatus and related software have to be developed, with a view to achieving in practice detonation at successive intervals which correspond as accurately as possible to the theoretically desired time intervals.

The behaviour of an explosively driven vibration in any particular rock medium is complex, and particularly when a sequence of explosively-derived vibrations is applied through the same rock medium, and inter-acting with each other. There is much published literature on the subject, and which might lead one to assume (erroneously) that blasting technology is now an exact science.

It is of course true that use of modern technology can give more efficient fragmentation of rock than the cruder techniques used in the past e.g. by use of fuses, but despite modern technology being available (including design of sophisticated software to control the blasting operation), in practice results can be of variable quality.

A desired fragmentation of a rock medium normally involves production of a major proportion of fragmented rock material reduced in size below a predetermined size, and without generation of (a) substantial amounts of larger fragments and (b) generation of excessive amounts of unusable small fragments and dust.

Furthermore, to the uninitiated, it might be thought that it would be a positive advantage to generate harmonic vibrations in a solid rock medium i.e. so that successive explosively driven vibrations reinforce each other to apply harmonic vibration to the entire rock mass. However, in practice this gives undesirable ground vibrations.

In particular, despite the use of sophisticated blasting techniques i.e. using theoretical calculations plus sophisticated electronic control equipment to implement the theory, it happens from time to time that harmonic vibrations are set-up in a particular rock mass as a result of a controlled sequence of explosions.

The harmonic vibrations may result in undesirable fragmentation of the rock, and also can give rise to significant environmental problems, which may generate unacceptable noise levels being generated and also by potentially damaging ground vibrations. Quarry sites often are located near to buildings e.g. houses or factory buildings, and environmental requirements are that noise and vibration levels must be kept below set limits.

Vibration measurements are normally required, prior to carrying out regular blasting operations, with a view to meeting requirements of local authority or other agencies controlling quarry operations. However, this involves extra costs which many site operators choose not to bear, with consequent adverse effects on residents living or working nearby.

It Is known from U.S. Pat No. 4,725,991 (Shell) that damaging vibrations can be set-up in the ground, during a rock blasting programme, and which can have adverse effect on (a) the quality of the fragmentation, (b) the efficiency of usage of the explosives and (c) the foundations and structure of any nearby buildings. The Shell patent also acknowledges that this subject has been addressed by many learned papers and publications e.g. by the US Departments of Mines, and all are agreed that very complex waveforms (at differing frequencies) are set-up in a rock mass as a result of a series of detonated explosive charges.

Also, it is recognised that relatively low frequency vibrations can have an adverse effect on building walls and foundations (a) from the point of view of horizontal waveform propagation, (b) vertical waveform propagation, and (c) lateral (shaking) displacement of the walls.

There are also desirable time intervals from the point of view of required fragmentation of a rock mass, and efficient usage of explosives.

In the Shell patent reference, while there are many references to the desirability of achieving optimum blasting timing (i.e. for good fragmentation while simultaneously avoiding undesirable ground vibrations affecting buildings), the actual teaching of the Shell patent is:

(a) to carry out a test explosion in a rock mass at a new site;

(b) measure the vibration profiles at selected measuring sites spaced from the test explosion; and, (c) use mathematical calculations to derive a desired singular best time interval between successive explosions of a series of charges spaced apart in boreholes in the rock mass, derived from best shot vibrational data The Shell reference teaches an elegant mathematical model utilised to reach the calculation of desired time intervals, but what is an essential aspect of this teaching is that the calculated time interval applies to the entire blasting programme, and which is a constant time interval between successive explosions in the row.

In particular, the teaching of the Shell reference can only deal with one frequency at a time, whereas the invention does not need a "test hole". Further, the Shell reference has the frequency depending upon charge weight.

Therefore, while the present invention is based on a shared recognition of the problem of simultaneously achieving (a) efficient fragmentation and (b) minimising undesirable building foundation-rocking vibrations, the solution offered by the Shell reference is fundamentally different from that provided by the invention.

The present invention thus seeks to alleviate this problem by providing improved and different means to control the timing of a detonation initiation system, with a view to overcoming, or at least mitigating the risk of harmonic vibrations being generated in a rock medium as a result of initiation of a sequential detonation of a series of explosive charges.

According to the invention there is provided a control system for controlling the initiation of detonation of a series of explosive charges spaced apart from each other in boreholes formed in a rock medium to be blasted, said system being operative to apply controlled time difference in the time interval between successive detonations of at least one phase of the series of charges, and which includes at least three successive detonations, so as to reduce the probability of consecutive stimulation and amplification of ground vibration by reason of the detonation of the charges in the rock medium.

Preferably, the system includes an electrically operated control device which is operative to initiate energisation of detonators associated one with each explosive charge in a respective borehole, and time interval control means for controlling the intervals between successive energisation of at least said one phase of the series of charges.

The means whereby the electrically operated control device initiates energisation of successive detonators can take any suitable form, including direct electrical connection lines, radio transmission or through use of "shock tubing" systems known per se.

Each detonator may have a respective individual time interval control unit associated with it. Alternatively, a common remote control unit may be provided to apply selected time intervals between successive energisations of the detonators of at least said part of the series of charges.

In a further preferred arrangement, the system includes an electrically operated control device operative to initiate energisation of detonators associated one with each explosive charge in a respective borehole, a sequential generator connected to the control device and which is programmed, or programmable, to cause operation of the control device so that the latter can initiate successive detonations of said one phase of the series of charges; and electronic adjuster means operative to initiate successive energisations of the detonators of at least said one phase of the series of charges at selected time intervals.

The electronic adjuster means may be connected to the control device and be arranged to be operative to apply predetermined adjustments to programmed time intervals set by the sequential generator. Alternatively, the electronic adjuster means may be connected to the sequential generator and be operative to apply predetermined adjustment to programmed time intervals set by the sequential generator.

The selection of the required time intervals will be dependent upon site factors, including (a) the circumstances of the particular rock mass to be blasted, and (b) the distance separating successively detonated explosive charges.

Therefore, in some circumstances, the selection of time intervals will be pre-determined such that successive (different) time intervals of at least one phase of the series of detonations differ from each other, so as to achieve a desired blasting sequence in which the risk of harmonic vibrations being set up in the rock mass is avoided, or at least minimised.

The invention therefore, by electronic means, may deliberately introduce a variable time portion into each successive time interval (in at least one phase) between successive detonations, thereby at least minimising the risk of generation of consecutive stimulation and amplification of harmonic vibrations and thereby inducing vibrational interference through frequency shifting. in the rock medium, while still achieving desired sequencing of explosive charges and fragmentation of the rock medium.

In a system according to the invention, the successive time intervals in at least one part of the series of detonations may be controlled so as to avoid (or at least minimise) the risk of harmonic vibrations (resonance) being set up in the rock mass. The successive grouped time intervals can be the same as each other in some circumstances of a particular rock mass. Alternatively, they may vary from one detonation to another by fixed amounts or by variable amounts, provided that the cumulative effect does not result in generation of harmonic vibrations in the rock mass.

In one preferred arrangement, the successive time intervals may be selected such that successive vibrational waveforms interfere one with another, again with a view to minimise or avoid, the generation of harmonic vibrations in the rock mass. By way of example, for a first time interval of x milliseconds, second and third time intervals could be ½x or ¼x respectively.

The first time interval therefore may be set at a minimum period to avoid so called "congestion" in the rock mass, and subsequent time intervals have progressively reduced time periods so as to create interference and thereby reduce the risks of resonant vibrations being set up.

According to a further aspect the invention also provides a method of controlling the initiation of detonation of a series of explosive charges spaced apart from each other in boreholes formed in a rock medium to be blasted, in which there is applied a controlled time difference in the time interval between successive detonations of at least one phase of the series of charges, and which includes at least three detonations, so as to reduce the probability of consecutive stimulation and amplification of ground vibration by reason of the detonation of the charges in the rock medium.

Figure 2:
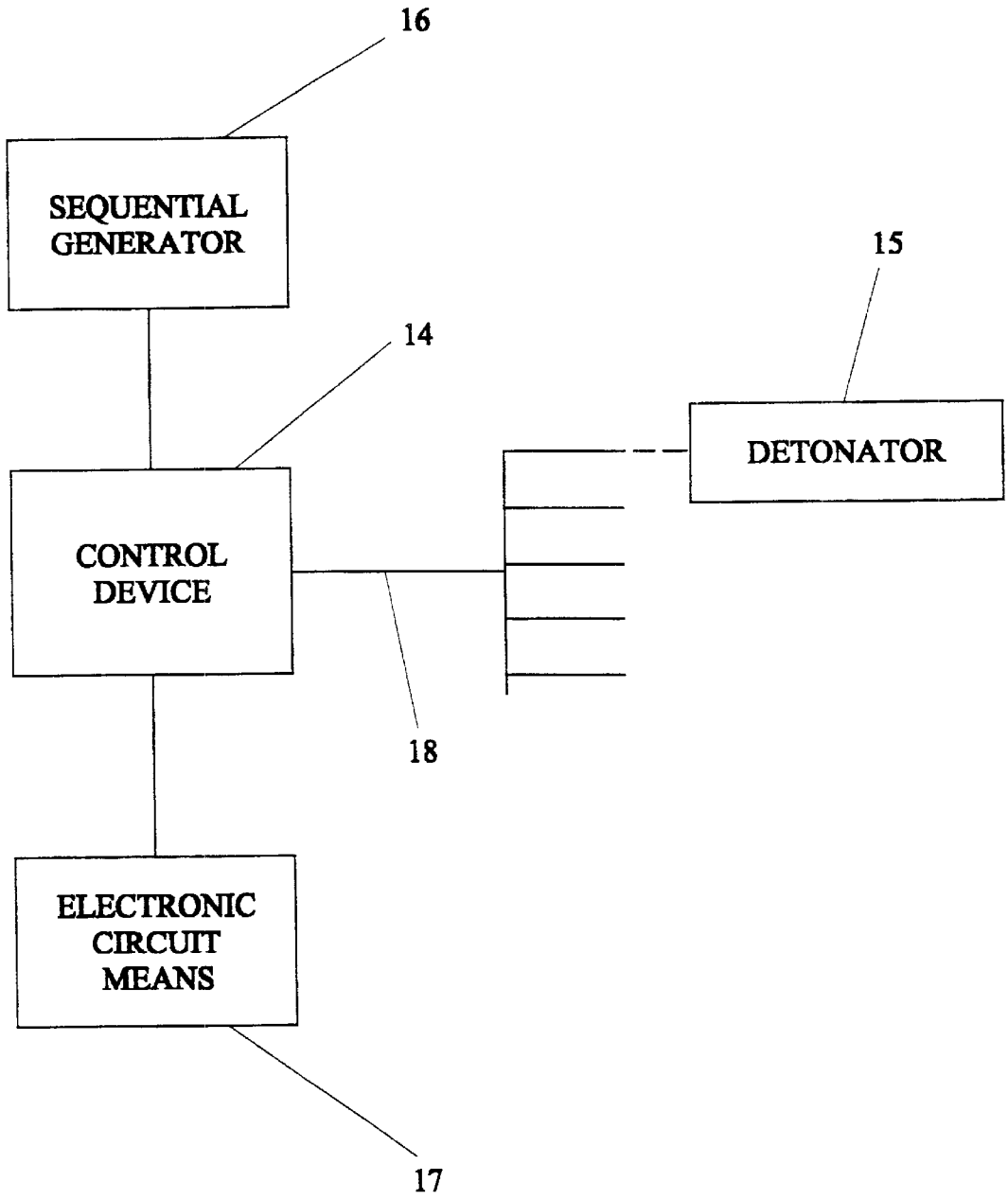

A preferred embodiment of the invention will now be described in detail, by way of example only, with reference to the accompanying drawings, in which:

FIG. 1 is a schematic illustration of a rock face having a series of explosive charges arranged in spaced boreholes, and to which a system according to the invention may be applied in order to initiate sequential detonation of a series of explosive charges; and, FIG. 2 is a diagrammatic illustration of the system according to the invention.

Referring first to FIG. 1 of the drawings, there is shown a rock face 10 having one or more rows 11 of spaced boreholes 12, each having an explosive charge 13 located therein, and having an electronic detonator associated therewith, and which can be triggered into operation by a remote electrically operated control device.

The apparatus according to the invention is intended to initiate sequential detonation of a series of explosive charges 13 spaced apart from each other in boreholes 12, and at successive time intervals such that a "free face" is formed by one explosion before a succeeding explosion takes place.

In the explosive fragmentation of a rock medium, it is important to achieve controlled successive time intervals between each detonation, to meet a number of separate critical criteria. First of all, the time intervals should not be too short, so as to avoid so-called "crowding" i.e. to achieve creation by each explosion of a "free face" of the rock, before a further explosive charge is detonated. Secondly, the time interval should not be too long, such that an entire curtain of rock formed by one explosive charge might have completely fallen away. Thirdly, the curtain of rock falling as a result of one explosion should still be adjacent to the rock face from which it has been formed, so that it is capable of acting to some extent as a shield against which fragmented rock material can impact after a subsequent explosive charge has been set-off. Fourthly, inter-borehole shear, and disruption of successive explosive charges should be avoided.

It should also be borne in mind that it is highly undesirable, (in any particular rock mass to be fragmented by a series of successive explosive charges), to permit harmonic vibration to be set-up in the rock mass. This gives rise to serious environmental hazards, possibly by way of excessive noise but primarily by ground vibration to residents living and/or working near the rock face e.g. a typical quarry installation. In connection with the location of buildings near to a quarry site, it is often very important to avoid generating frequencies in the range 5 to 18 Hertz, which are liable to set-up harmonic vibrations in the structure of the building.

The embodiment of the invention shown in FIG. 2 of the drawings is intended to introduce deliberately a variable time interval between successive detonations (in at least one part or phase of a series of detonations), with a view to avoiding the drawbacks referred to above. In particular, the invention seeks to overcome, or at least mitigate the risk of consecutive stimulations and amplifications of ground vibration being generated as a result of initiation of a sequential detonation of a series of explosive charges.

A series of detonations can be up to 200 (or more) separate detonations, and it is important to avoid harmonic vibrations being set-up in the rock mass as a result of the detonations. This means in practice that there should be different time intervals between successive detonations in at least one phase of the series e.g. a phase of at least three detonations, and that such variations may be applied in further phases of the series. Each distinct "phase" of a series of explosive detonations (e.g. up to 200) is preferably selected to be at least three detonations, since in practice most residual vibration imparted to the rock mass by any portion of the sequence of explosions of the phase will have virtually died away by the time the sequence is subsequently repeated.

To put it another way, the invention provides, as a minimum requirement, that the time interval $t_{1,2}$ between explosion 1 and explosion 2, and the time interval $t_{2,3}$ between explosion 2 and explosion 3 (in a phase of at least three explosions of a series of explosions) is carefully controlled, and with $t_{1,2}$ being different from $t_{2,3}$ so as to avoid consecutive stimulation and amplification of vibrations being set-up in the rock mass.

Subject to site analysis, a minimum period of, say, 18 milliseconds could be determined, and a maximum of, say, 140 milliseconds. Then, after firing of the first shot, the determined maximum (140ms) could be e.g. halved for the second shot (70 ms) and e.g. halved again for the third shot (35 ms). The sequence could then be repeated.

The inputting of suitable firing data can be carried out by named input to an appropriate software program, or the entire set-up can be computer controlled as to input and output.

The difference in time interval may be achieved by providing (1) detonator caps having equal time delays between being triggered and causing detonation of the associated explosive charge, and (2) varying the time interval between successive triggering of the detonator caps. Alternatively, the detonator caps may be selected to have varied time delays, and to provide equal time intervals between successive triggering of the detonator caps. Still further, the required variable time interval between successive explosions may be obtained by a carefully controlled selection of (a) varied time delay detonator caps and (b) controlled time interval between successive triggering of the caps.

Depending upon the time interval between successive phases e.g. if they are sufficiently delayed that the "bell ringing" effect in the rock mass has died down (typically 1 to 4 cycles), the time interval variations between detonations in one or more subsequent phase of the series may be repeated i.e. be the same as the time intervals in a first of the phases.

The apparatus comprises a remote electrically operated control device 14 which is connectable to electrically energisable detonators associated one with each explosive charge 13 in a respective borehole 12, a typical one of these detonators being designated by reference 15 in FIG. 2. Preferably the detonator 15 is a so-called "electronic detonator", which will be well known to those of ordinary skill in the art of blasting technology, and need not be described in more detail herein.

A sequential generator circuit 16 is connected to the control device 14, and is programmed, or capable of being programmed to cause operation of the control device 14 so that the latter can initiate successive detonations of the explosive charges 13 in any particular series.

The apparatus also includes suitable electronic circuit means 17 which is operative to cause the control device 14 to initiate successive energisation of the detonators (in at least one phase of a series of detonations e.g. a sequence of three detonations; and preferably in more than one phase of the series) at time intervals which differ from each other so as to avoid, or at least minimise the generation of harmonic vibrations in the rock medium.

The electronic circuit means 17 may be arranged to introduce calculated variable elements to the time intervals between successive initiation of detonation of the explosive charges, and this will be set-up so as to avoid the drawbacks referred to above. In a typical situation, given by way of example only, there might be a time interval of 25 milliseconds between detonation 1 and detonation 2, a time interval of 50 milliseconds between detonation of explosive charge 2 and explosive charge 3, and a time interval of 30 milliseconds between detonation of explosive charge 3 and explosive charge 4. The difference in the time interval is a calculated variable, which variable will be determined empirically according to any particular rock material or site conditions.

The invention may be applied to control the time intervals from hole to hole in a row to provide "interhole" delays. Alternatively, or in addition, the invention may be applied to control inter-row delay intervals. Also, the inventions may be applied to control the delay intervals in "ring shot" detonation e.g. as used in tunnelling.

The time delays may be manually entered, or be auto-calculated to be variable by required amounts, and/or be randomly generated. It is envisaged that a computer programme may be developed, into which various site parameters could be entered, and using suitable mathematical models, suitable software can be developed so as to achieve required differences in time intervals between the successive detonations of at least one phase of a series of detonations.

Therefore, in a system according to the invention, the successive time intervals in at least one part of the series of detonations are controlled so as to avoid, or at least minimise, the risk of harmonic vibrations (resonance) being set up in the rock mass. The pattern repeats can be the same as each other in some circumstances of a particular rock mass. Alternatively, they may vary from one pattern to another by fixed amounts or by variable amounts, provided that the cumulative effect does not result in generation of harmonic vibrations in the rock mass.

In one preferred arrangement, the electronic circuit means 17 is programmed to receive suitable input so that successive time intervals can be selected such that successive vibrational waveforms interfere one with another, again with a view to minimise, or avoid, the generation of harmonic vibrations in the rock mass. By way of example, for a first time interval of x milliseconds, second and third time intervals could be ½x and ¼x respectively.

The first time interval therefore may be set at a maximum period to avoid so called "congestion" in the successive vibrations applied to the rock mass (and also to maintain the so-called "curtain" effect), and subsequent time intervals can have progressively reduced time periods so as to create interference and thereby reduce the risks of resonant vibrations being set up.

It should be understood that the example shown in FIG. 2 is a schematic illustration only, and that many variations to the illustrated system may be provided, within the scope of the claimed invention.

In particular, the electrically operated control device can be arranged to initiate energisation of successive detonators via electrical connection lines, radio transmission or through a "shock tubing" system known per se.

The illustrated embodiment is a common remote control unit which applies selected time intervals between successive energisation of the detonators. However, in an alternative arrangement, not shown, each detonator may have a respective individual time interval control unit associated therewith.

FIG. 2 illustrates schematically the provision of a sequential generator 16 and electronic circuit means 17. These components effectively comprise, jointly, time interval control means for controlling the intervals between successive energisation of at least part of the series of explosive charges.

In another embodiment, the sequential generator 16 is retained, and is connected to the control device 14, being programmed, or programmable, to cause operation of the control device 14 so that the latter can initiate successive detonations of the series of explosive charges. In addition, although not shown in detail, the electronic circuit means 17 may comprise an electronic adjuster means, and which may be connected to the control device 14, as shown in FIG. 2, and be operative to apply predetermined adjustments to programmed time intervals set by the sequential generator 16.

Alternatively, the electronic adjuster means may be connected to the sequential generator 16, and be operative to apply predetermined adjustments to programmed time intervals set by the sequential generator 16.

The selection of the required time intervals which are inputted to the electronic means 17 will be dependent upon site factors, including a) the circumstances of the particular rock mass to be blasted and b) the distance separating successively detonated explosive charges.

The selection of time intervals may be predetermined such that successive time intervals of at least one part of the series of charges differ from each other, so as to achieve a desired blasting sequence in which the risk of harmonic vibrations being set up is avoided, or at least minimised.

The electronic adjuster means 17 may be programmed to introduce deliberately a variable time portion into each successive time interval. Alternatively, it may be programmed so that successive energisations are initiated at successive time intervals which differ from each other by such amount that successive vibrational wave-forms imparted to the rock mass interfere with each other.

To conclude, the essential features of the invention are to achieve time difference between successive detonations of at least one phase (e.g. a sequence of three detonations) of a series of detonations (e.g. up to 200 detonations), so as to obtain efficient and desired fragmentation of a rock mass, while minimising the generation of low frequency vibrations liable to have an adverse effect on buildings nearby. As referred to above, the time intervals should not be too short, so as to avoid so-called "crowding", but should not be too long, such that an entire curtain of rock formed by one explosive charge might have completely fallen away. Finally, the curtain of rock failing as a result of one explosion should still be adjacent to the rock face from which it has been formed, so that it is capable of acting to some extent as a shield against which fragmented rock material can impact after a subsequent explosive charge has been set off.

Here required time difference between successive detonations can be achieved by: (a) utilising detonator caps having constant time delays between energisation and detonation, plus varied time interval between successive energisation; (b) varied time delay detonator caps, and either constant time delay between successive energisations, or even uniform energisation of at least each phase; and (c) varied time interval between successive energisations of each phase plus varied detonator cap time delays. Regardless of which means is adopted, the invention requires time difference between successive detonations of at least one phase of a series of detonations.

What is claimed is:

1. A control system for controlling the initiation of detonation of a series of explosive charges (13) spaced apart from each other in boreholes (12) formed in a rock medium (10) to be blasted, said system being operative to apply controlled time difference in the time interval between successive detonations of at least one phase of the series of charges, and which includes at least three successive detonations, so as to reduce the probability of consecutive stimulation and amplification of ground vibration by reason of the detonation of the charges in the rock medium, said control system comprising:

an electrically operated control device (14) operative to initiate energisation of detonators (15) associated one with each explosive charge (13) in a respective borehole (12);

a sequential generator (16) connected to said control device (14) and which is programmed, or programmable, to cause operation of the control device so that the latter can initiate successive detonations of the series of explosive charges; and, electronic adjuster means (17) operative to initiate successive energisations of the detonators (15) of at least said one phase of the series of charges at selected different time intervals which have the effect of avoiding, or at least minimising, the generation of undesirable harmonic vibrations in the rock medium (10), wherein the electronic adjuster means (17) is connected to the control device (14) and is operative to apply predetermined adjustments to programmed time intervals set by the sequential generator (16).

2. A system according to claim 1, and comprising:

an electrically operated control device (14) operative to initiate energisation of detonators (15) associated one with each explosive charge (13) in a respective borehole (12); and, time interval control means for controlling the intervals between successive energisations of at least said one phase of the series of charges.

3. A system according to claim 2, in which each detonator has a respective individual time interval control unit associated therewith.

4. A system according to claim 2, in which a common remote control unit is provided to supply selective time intervals between successive energisation of the detonators of at least said one phase of the series of charges.

5. A system according to claim 1, in which the electronic adjuster means (17) is connected to the sequential generator (16) and is operative to apply predetermined adjustments to programmed time intervals set by the sequential generator (16).

6. A system according to claim 1, in which the selection of the required time intervals which are inputted to the electronic means (17) is dependent upon site factors, including (a) the circumstances of the particular rock mass (10) to be blasted and (b) the distance separating successively detonated explosive charges (13).

7. A system according to claim 6, in which the selection of different time intervals is predetermined such that successive time intervals of at least said one phase of the series of charges differ from each other, so as to achieve a desired blasting sequence in which the risk of harmonic vibrations being set up in the rock mass is avoided, or at least minimised.

8. A system according to claims 6 or 7, in which the electronic adjuster means (17) is programmed to introduce deliberately a variable time portion into each successive time interval between successive detonations of said at least one phase of the series of charges.

9. A system according to claim 1, in which the electronic adjuster means (17) is programmed to initiate successive energisations of the detonators (15) of said at least one phase of the series of charges at successive time intervals which differ from each other by such amounts that successive vibrational wave-forms imparted to the rock mass interfere with each other, thereby to at least minimize the generation of undesirable harmonic vibrations in the rock mass (10).

10. A system according to any one of claims 2–9, in which the electrically operated control device (14) is operative to initiate energisation of successive detonators (15) via electrical connection lines, radio transmission or through a "shock tubing" system.

11. A control system for controlling the initiation of detonation of a series of explosive charges (13) spaced apart from each other in boreholes (12) formed in a rock medium (10) to be blasted, said system being operative to apply controlled time difference in the time interval between successive detonations of at least one phase of the series of charges, and which includes at least three successive detonations, so as to reduce the probability of consecutive stimulation and amplification of ground vibration by reason of the detonation of the charges in the rock medium, wherein said control system comprises:

an electrically operated control device (14) operative to initiate energisation of detonators (15) associated one with each explosive charge (13) in a respective borehole (12);

a sequential generator (16) connected to said control device (14) and which is programmed, or programmable, to cause operation of the control device so that the latter can initiate successive detonations of the series of explosive charges; and, electronic adjuster means (17) operative to initiate successive energisations of the detonators (15) of at least said one phase of the series of charges at selected different time intervals which have the effect of avoiding, or at least minimizing, the generation of undesirable harmonic vibrations in the rock medium (10), wherein the electronic adjuster means (17) is connected to the sequential generator (16) and is operative to apply predetermined adjustments to programmed time intervals set by the sequential generator (16).

12. A system according to claim 11, and comprising:

an electrically operated control device (14) operative to initiate energisation of detonators (15) associated one with each explosive charge (13) in a respective borehole (12); and time interval control means for controlling the intervals between successive energisations of at least said one phase of the series of charges.

13. A system according to claim 12, in which each detonator has a respective individual time interval control unit associated therewith.

14. A system according to claim 12, in which a common remote control unit is provided to supply selective time intervals between successive energisation of the detonators of at least said one phase of the series of charges.

15. A system according to any one of claim 12, in which the selection of the required time intervals which are inputted to the electronic means (17) is dependent upon site factors, including (a) the circumstances of the particular rock mass (10) to be blasted and (b) the distance separating successively detonated explosive charges (13).

16. A system according to claim 15, in which the selection of different time intervals is predetermined such that successive time intervals of at least said one phase of the series of charges differ from each other, so as to achieve a desired blasting sequence in which the risk of harmonic vibrations being set up in the rock mass is avoided, or at least minimized.

17. A system according to claim 15, in which the electronic adjuster means (17) is programmed to introduce deliberately a variable time portion into each successive time interval between successive detonations of said at least one phase of the series of charges.

18. A control system for controlling the initiation of detonation of a series of explosive charges (13) spaced apart from each other in boreholes (12) formed in a rock medium (10) to be blasted, said system being operative to apply controlled time difference in the time interval between successive detonations of at least one phase of the series of charges, and which includes at least three successive detonations, so as to reduce the probability of consecutive stimulation and amplification of ground vibration by reason of the detonation of the charges in the rock medium, wherein said control system comprises:

an electrically operated control device (14) operative to initiate energisation of detonators (15) associated one with each explosive charge (13) in a respective borehole (12);

a sequential generator (16) connected to said control device (14) and which is programmed, or programmable, to cause operation of the control device so that the latter can initiate successive detonations of the series of explosive charges; and, electronic adjuster means (17) operative to initiate successive energisations of the detonators (15) of at least said one phase of the series of charges at selected different time intervals which have the effect of avoiding, or at least minimizing, the generation of undesirable harmonic vibrations in the rock medium (10), wherein the electronic adjuster means (17) is programmed to initiate successive energisations of the detonators (15) of said at least one phase of the series of charges at successive time intervals which differ from each other by such amounts that successive vibrational wave-forms imparted to the rock mass interfere with each other, thereby to at least minimize the generation of undesirable harmonic vibrations in the rock mass (10).

19. A system according to claim 18, and comprising:

an electrically operated control device (14) operative to initiate energisation of detonators (15) associated one with each explosive charge (13) in a respective borehole (12); and time interval control means for controlling the intervals between successive energisations of at least said one phase of the series of charges.

20. A system according to claim 19, in which each detonator has a respective individual time interval control unit associated therewith.

21. A system according to claim 19, in which a common remote control unit is provided to supply selective time intervals between successive energisation of the detonators of at least said one phase of the series of charges.

* * * * *